US010316498B2

(12) United States Patent
Morimoto

(10) Patent No.: US 10,316,498 B2
(45) Date of Patent: Jun. 11, 2019

(54) EXCAVATOR

(71) Applicant: SUMITOMO(S.H.I.) CONSTRUCTION MACHINERY CO., LTD., Tokyo (JP)

(72) Inventor: Takaaki Morimoto, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 15/704,448

(22) Filed: Sep. 14, 2017

(65) Prior Publication Data

US 2018/0002899 A1 Jan. 4, 2018

Related U.S. Application Data

(63) Continuation of application No. PCT/JP2016/058566, filed on Mar. 17, 2016.

(30) Foreign Application Priority Data

Mar. 19, 2015 (JP) ..... 2015-056872

(51) Int. Cl.

| | |
|---|---|
| ***E02F 9/26*** | (2006.01) |
| ***E02F 3/43*** | (2006.01) |
| ***E02F 9/22*** | (2006.01) |
| *E02F 3/32* | (2006.01) |

(52) U.S. Cl.

CPC ..... *E02F 9/261* (2013.01); *E02F 3/43* (2013.01); *E02F 3/435* (2013.01); *E02F 9/2228* (2013.01); *E02F 9/26* (2013.01); *E02F 9/262* (2013.01); *E02F 9/264* (2013.01); *E02F 3/32* (2013.01)

(58) Field of Classification Search

CPC . E02F 9/261; E02F 9/264; E02F 9/262; E02F 3/435; E02F 9/2228; E02F 3/43; E02F 9/26; E02F 3/32

USPC ..... 701/1, 50

See application file for complete search history.

(56) References Cited

U.S. PATENT DOCUMENTS

| | | | | |
|---|---|---|---|---|
| 9,644,346 | B2 * | 5/2017 | Seki | E02F 9/264 |
| 2006/0070773 | A1 * | 4/2006 | Dahl | G01G 19/083 177/136 |
| 2009/0228169 | A1 * | 9/2009 | Chiorean | E02F 3/435 701/29.1 |

(Continued)

FOREIGN PATENT DOCUMENTS

| | | |
|---|---|---|
| DE | 112012000290 | 8/2014 |
| JP | H04-136324 | 5/1992 |

(Continued)

OTHER PUBLICATIONS

International Search Report for PCT/JP2016/058566 dated Jun. 7, 2016.

*Primary Examiner* — Jaime Figueroa
(74) *Attorney, Agent, or Firm* — IPUSA, PLLC

(57) ABSTRACT

An excavator includes a machine guidance device having a machine guidance function, wherein the machine guidance function sets a standard surface at a position closer to a ground surface than an excavation target surface, compares a height of a region of work by an end attachment with a height of the standard surface, and performs guidance by a report sound based on a result of the comparison.

16 Claims, 9 Drawing Sheets

(56) References Cited

U.S. PATENT DOCUMENTS

| | | | | |
|---|---|---|---|---|
| 2010/0023229 | A1* | 1/2010 | Chiocco | A01B 69/003 701/50 |
| 2013/0158784 | A1* | 6/2013 | Fukano | E02F 9/2033 701/34.4 |
| 2013/0166143 | A1* | 6/2013 | Seki | E02F 9/264 701/34.4 |
| 2013/0176120 | A1 | 7/2013 | Shibamori et al. | |
| 2013/0212912 | A1* | 8/2013 | Guggino | E01H 5/061 37/197 |
| 2014/0099178 | A1* | 4/2014 | Nomura | E02F 3/32 414/685 |
| 2014/0100712 | A1* | 4/2014 | Nomura | E02F 3/32 701/1 |
| 2014/0257647 | A1* | 9/2014 | Wu | E02F 9/24 701/50 |
| 2014/0320293 | A1* | 10/2014 | Hunter, Jr. | G01L 19/12 340/626 |
| 2015/0218781 | A1* | 8/2015 | Nomura | E02F 3/435 701/50 |
| 2016/0024757 | A1 | 1/2016 | Nomura et al. | |
| 2016/0125666 | A1 | 5/2016 | Izumikawa et al. | |

FOREIGN PATENT DOCUMENTS

| | | |
|---|---|---|
| JP | H08-049260 | 2/1996 |
| JP | H11-051628 | 2/1999 |
| JP | 2011-231489 | 11/2011 |
| JP | 2012-072617 | 4/2012 |
| JP | 2012-172431 | 9/2012 |
| JP | 2014-098270 | 5/2014 |
| JP | 2014-148893 | 8/2014 |
| JP | 2014-205955 | 10/2014 |
| JP | 2015-021258 | 2/2015 |

* cited by examiner

EXCAVATOR

CROSS-REFERENCE TO RELATED APPLICATION

The present application is a continuation application of International Application No. PCT/JP2016/058566 filed on Mar. 17, 2016, which claims priority to Japanese Priority Patent Application No. 2015-056872, filed on Mar. 19, 2015. The contents of these applications are incorporated herein by reference in their entirety.

BACKGROUND OF THE INVENTION

1. Field of the Invention

The present invention relates to an excavator including a machine guidance function.

2. Description of the Related Art

Skilled operation techniques are required of operators of construction machines such as excavators, in order to efficiently and accurately perform work such as excavation with attachments. Therefore, there is an excavator provided with a function (referred to as machine guidance) for guiding the operation of the excavator, so that even an operator with little operation experience of the excavator can perform the work efficiently and accurately.

For example, as a machine guidance of an excavator, there is known a display system that displays, as images, a cross section of a part where excavation work is performed and a bucket used as an excavation tool, on a display device, to visually guide the work (for example, refer to Patent Literature 1). In this display system, for example, an excavation target line indicating an excavation target surface and the trajectory of the toe of the bucket are displayed on the cross section of the part to be excavated. By comparing the trajectory of the toe of the bucket with the excavation target line, the operator can confirm how accurately the excavation has been done.

The depth from the actual ground surface to the excavation target surface varies depending on the excavation site. When the excavation target surface is shallow, the ground is excavated such that the bucket moves closer to the excavation target surface with high accuracy while moving at low speed. On the other hand, when the excavation target surface line is deep, rough drilling may be performed so as to scoop earth and sand while inserting the bucket deeply into the ground.

However, when such rough drilling is performed, there is a risk that the toe of the bucket is erroneously inserted deeper than the excavation target surface, and excavation is performed deeper than the excavation target surface. The display system described above merely displays the excavation target surface and the toe position of the bucket, and therefore it is impossible to reliably prevent the excavation from being performed deeper than the excavation target surface.

SUMMARY OF THE INVENTION

An aspect of the present invention provides an excavator, in which one or more of the above-described disadvantages are reduced.

According to one aspect of the present invention, there is provided an excavator including a machine guidance device having a machine guidance function. The machine guidance function sets a standard surface at a position closer to a ground surface than an excavation target surface, compares a height of a region of work by an end attachment with a height of the standard surface, and performs guidance by a report sound based on a result of the comparison.

DETAILED DESCRIPTION OF THE PREFERRED EMBODIMENTS

A problem to be solved by an embodiment of the present invention is to provide an excavator that can report to the operator that the excavation has been performed to an excavation depth that is a standard depth, before guidance is given with respect to the excavation target surface.

An embodiment of the present invention will be described with reference to drawings.

Figure 1:
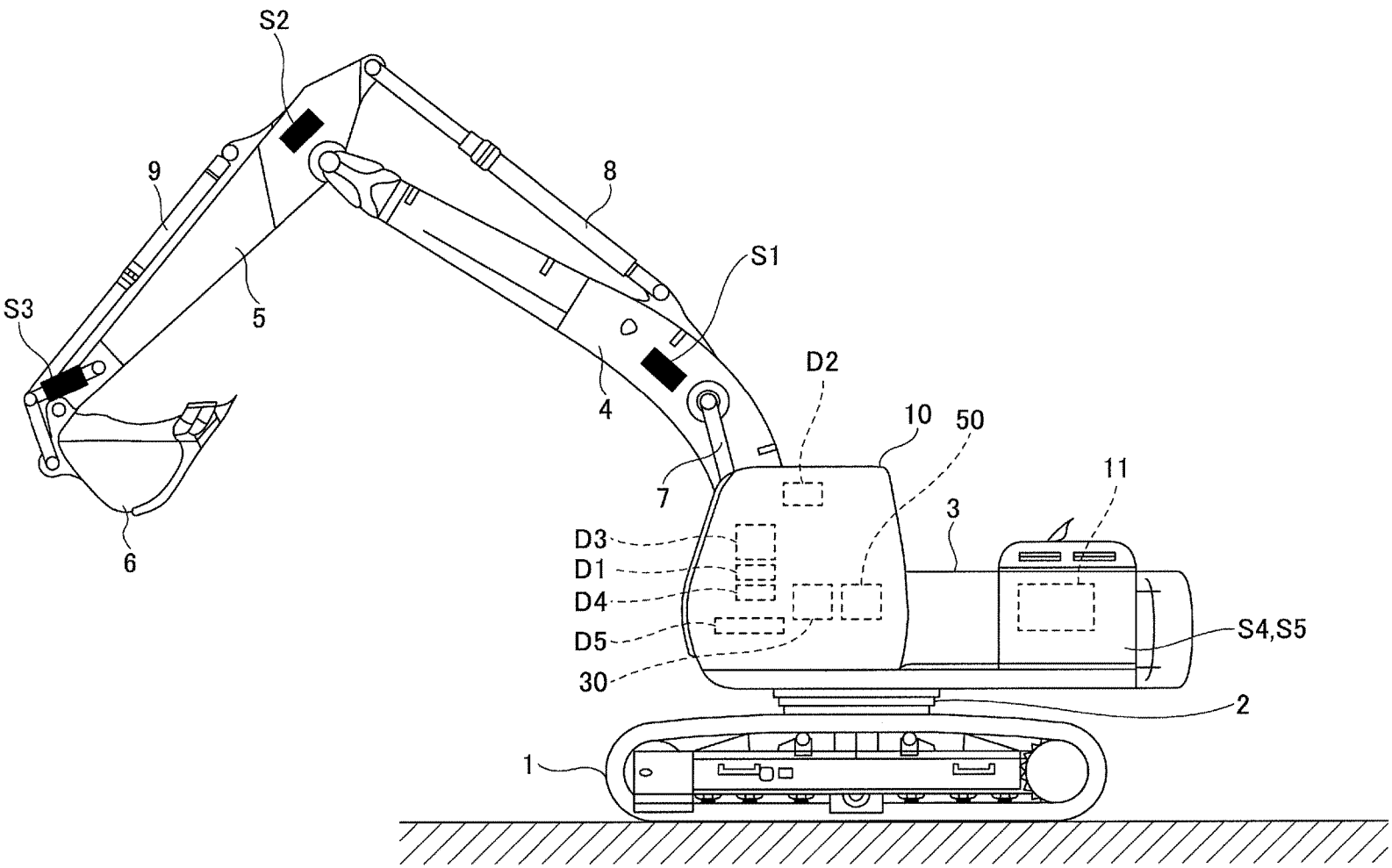
FIG. 1 is a side view of an excavator according to an embodiment of the present invention.

FIG. 1 is a side view of an excavator according to an embodiment. An upper turning body 3 is mounted on a lower travelling body 1 of the excavator, via a turning mechanism 2. A boom 4 is attached to the upper turning body 3. An arm 5 is attached to a front end of the boom 4, and a bucket 6 as an end attachment is attached to the tip of the arm 5. As an end attachment, a slope work bucket or a dredging bucket, etc., may be used.

The boom 4, the arm 5, and the bucket 6 constitute an excavator attachment as an example of an attachment, and are hydraulically driven by a boom cylinder 7, an arm cylinder 8, and a bucket cylinder 9, respectively. A boom angle sensor S1 is attached to the boom 4, an arm angle sensor S2 is attached to the arm 5, and a bucket angle sensor S3 is attached to the bucket 6. A bucket tilt mechanism may be provided in the excavator attachment. The boom angle sensor S1, the arm angle sensor S2, and the bucket angle sensor S3 may be referred to as "attitude sensors" in some cases.

The boom angle sensor S1 detects the rotation angle of the boom 4. In the present embodiment, the boom angle sensor S1 is an acceleration sensor that detects the inclination with respect to the horizontal plane and detects the rotation angle of the boom 4 with respect to the upper turning body 3. The arm angle sensor S2 detects the rotation angle of the arm 5. In the present embodiment, the arm angle sensor S2 is an acceleration sensor that detects the inclination with respect to the horizontal plane and detects the rotation angle of the arm 5 with respect to the boom 4. The bucket angle sensor S3 detects the rotation angle of the bucket 6. In the present embodiment, the bucket angle sensor S3 is an acceleration sensor that detects the inclination with respect to the horizontal plane and detects the rotation angle of the bucket 6 with respect to the arm 5. When the excavator attachment includes a bucket tilt mechanism, the bucket angle sensor S3 additionally detects the rotation angle of the bucket 6 around the tilt axis. The boom angle sensor S1, the arm angle sensor S2, and the bucket angle sensor S3 may be a potentiometer using a variable resistor, a stroke sensor that detects the stroke amount of a corresponding hydraulic cylinder, or a rotary encoder that detects the rotation angle around a connecting pin, etc.

A cabin 10 is provided on the upper turning body 3, and a power source such as an engine 11 is mounted on the upper turning body 3. Furthermore, a body inclination sensor S4 is attached to the upper turning body 3. The body inclination sensor S4 is a sensor that detects the inclination of the upper turning body 3 with respect to the horizontal plane. The body inclination sensor S4 may also be referred to as an "attitude sensor".

In the cabin 10, an input device D1, a voice sound output device D2, a display device D3, a storage device D4, a gate lock lever D5, a controller 30, and a machine guidance device 50 are installed.

The controller 30 functions as a main control unit that performs drive control of the excavator. In the present embodiment, the controller 30 is constituted by an arithmetic processing unit including a CPU and an internal memory. Various functions of the controller 30 are implemented by the CPU executing programs stored in the internal memory.

The machine guidance device 50 guides the operation of the excavator. In the present embodiment, for example, the machine guidance device 50 visually and audibly reports, to the operator, the distance in the vertical direction between the surface of the target landform set by the operator and the tip (toe) position of the bucket 6. Accordingly, the machine guidance device 50 guides the operation of the excavator by the operator. Note that the machine guidance device 50 may only visually report the distance to the operator, or may only audibly report the distance to the operator. Specifically, similar to the controller 30, the machine guidance device 50 is constituted by an arithmetic processing unit including a CPU and an internal memory. Various functions of the machine guidance device 50 are implemented by the CPU executing programs stored in the internal memory. The machine guidance device 50 may be provided separately from the controller 30, or may be incorporated in the controller 30.

The input device D1 is a device for the operator of the excavator to input various kinds of information to the machine guidance device 50. In the present embodiment, the input device D1 is a membrane switch attached to the surface of the display device D3. A touch panel, etc., may be used as the input device D1.

The voice sound output device D2 outputs various kinds of voice sound information in response to a voice sound output command from the machine guidance device 50. In the present embodiment, an in-vehicle speaker, which is directly connected to the machine guidance device 50, is used as the voice sound output device D2. Note that a reporting device such as a buzzer may be used as the voice sound output device D2.

The display device D3 outputs various kinds of image information in response to a command from the machine guidance device 50. In the present embodiment, an in-vehicle liquid crystal display, which is directly connected to the machine guidance device 50, is used as the display device D3.

The storage device D4 is a device for storing various kinds of information. In the present embodiment, a non-volatile storage medium such as a semiconductor memory is used as the storage device D4. The storage device D4 stores various kinds of information output by the machine guidance device 50, etc.

The gate lock lever D5 is a mechanism for preventing the excavator from being erroneously operated. In the present embodiment, the gate lock lever D5 is disposed between the door of the cabin 10 and the driver's seat. When the gate lock lever D5 is pulled up such that the operator cannot exit the cabin 10, various operation devices become operable. On the other hand, when the gate lock lever D5 is depressed such that the operator can exit the cabin 10, various operation devices become inoperable.

Figure 2:
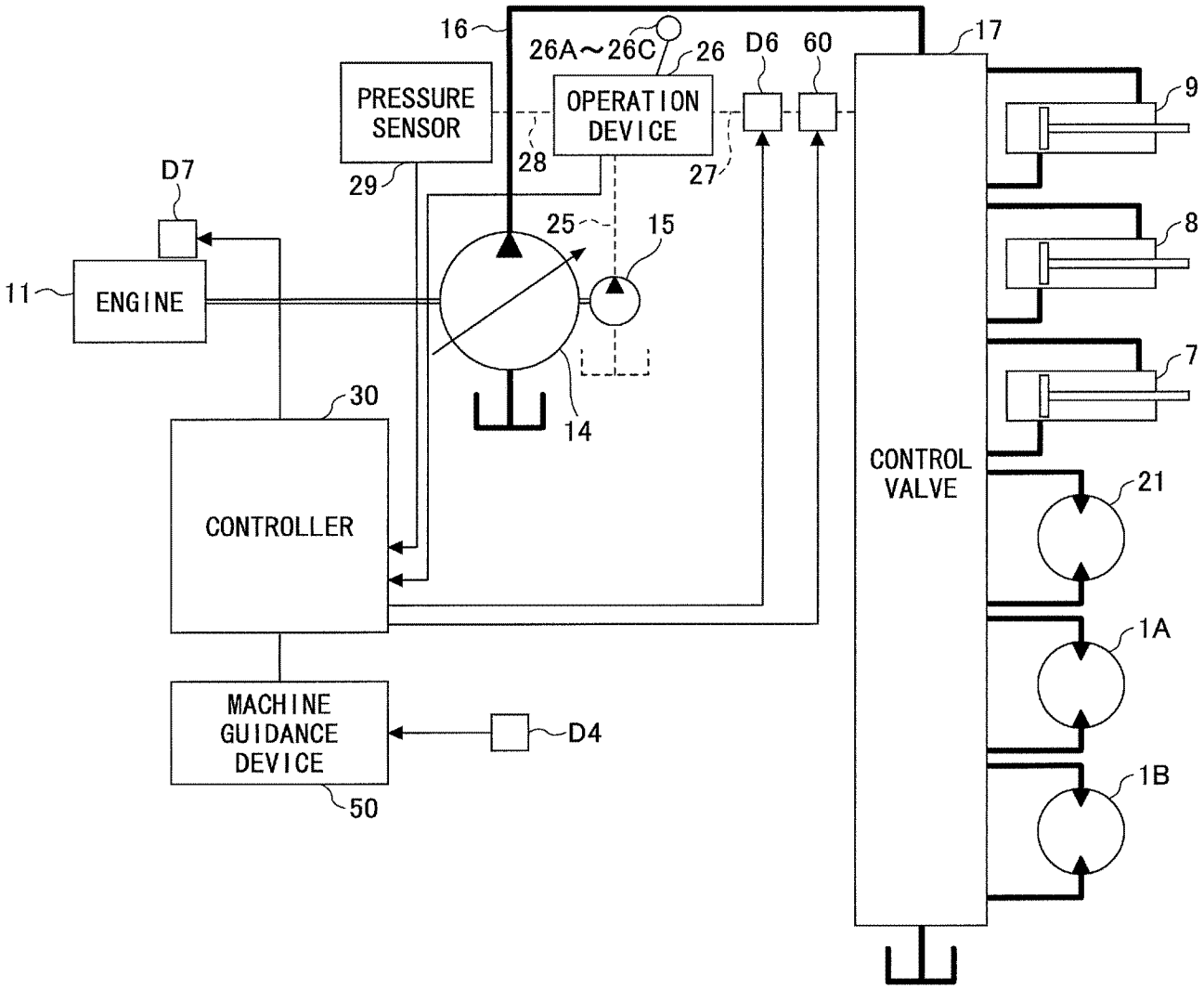
FIG. 2 is a block diagram showing a configuration of a driving system of the excavator of FIG. 1.

FIG. 2 is a block diagram showing a configuration of a driving system of the excavator of FIG. 1. In FIG. 2, a mechanical power system is indicated by double lines, high-pressure hydraulic lines are indicated by thick solid lines, pilot lines are indicated by dashed lines, and electric drive and control systems are indicated by thin solid lines.

The engine 11 is a power source of the excavator. In the present embodiment, the engine 11 is a diesel engine that employs isochronous control for maintaining a constant engine rotational speed regardless of an increase or a decrease in the engine load. The fuel injection amount, the fuel injection timing, and the boost pressure, etc., in the engine 11 are controlled by an engine controller D7.

The engine controller D7 is a device for controlling the engine 11. In the present embodiment, the engine controller D7 executes various functions such as an automatic idle function and an automatic idle stop function.

The automatic idle function is a function of reducing the engine rotational speed from a regular rotational speed (for example, 2000 rpm) to an idle rotational speed (for example, 800 rpm), when a predetermined condition is satisfied. In the present embodiment, the engine controller D7 operates the automatic idle function according to an automatic idle command from the controller 30 to reduce the engine rotational speed to the idle rotational speed.

The automatic idle stop function is a function of stopping the engine 11 when a predetermined condition is satisfied. In the present embodiment, the engine controller D7 operates the automatic idle stop function in response to an automatic idle stop command from the controller 30 to stop the engine 11.

A main pump 14 and a pilot pump 15, as hydraulic pumps, are connected to the engine 11. A control valve 17 is connected to the main pump 14 via a high pressure hydraulic line 16.

The control valve 17 is a hydraulic control device that controls the hydraulic system of the excavator. Hydraulic actuators such as a right side traveling hydraulic motor 1A, a left side traveling hydraulic motor 1B, the boom cylinder 7, the arm cylinder 8, the bucket cylinder 9, and a turning hydraulic motor 21, etc., are connected to the control valve 17 via a high pressure hydraulic line.

An operation device 26 is connected to the pilot pump 15 via a pilot line 25.

The operation device 26 includes a lever 26A, a lever 26B, and a pedal 26C. In the present embodiment, the operation device 26 is connected to the control valve 17 via a hydraulic line 27 and a gate lock valve D6. Furthermore, the operation device 26 is connected to a pressure sensor 29 via a hydraulic line 28.

The gate lock valve D6 switches the communication/shutoff of the hydraulic line 27 connecting the control valve 17 and the operation device 26. In the present embodiment, the gate lock valve D6 is a solenoid valve that switches communication/shutoff of the hydraulic line 27 according to a command from the controller 30. The controller 30 determines the state of the gate lock lever D5 based on a state signal output from the gate lock lever D5. Then, when the controller 30 determines that the gate lock lever D5 is in a pulled up state, the controller 30 outputs a communication command to the gate lock valve D6. Upon receiving the communication command, the gate lock valve D6 opens to bring the hydraulic line 27 into communication. As a result, the operator's operation on the operation device 26 becomes effective. On the other hand, when the controller 30 determines that the gate lock lever D5 is in a pulled down state, the controller 30 outputs a shutoff command to the gate lock valve D6. Upon receiving the shutoff command, the gate lock valve D6 is closed to shut off the hydraulic line 27. As a result, the operator's operation on the operation device 26 becomes invalid. Furthermore, a pressure reducing valve 60 is provided between the gate lock valve D6 and the control valve 17. By the pressure reducing valve 60, the pilot pressure to the control valve 17 can be adjusted. Accordingly, when the toe of the bucket 6 exceeds a predetermined standard line to be described later, the movement of the attachments such as the boom 4, the arm 5, and the bucket 6, etc., with respect to a lever operation amount, can be delayed.

The pressure sensor 29 detects the operation content of the operation device 26, in the form of pressure. The pressure sensor 29 outputs a detection value to the controller 30.

Figure 3:
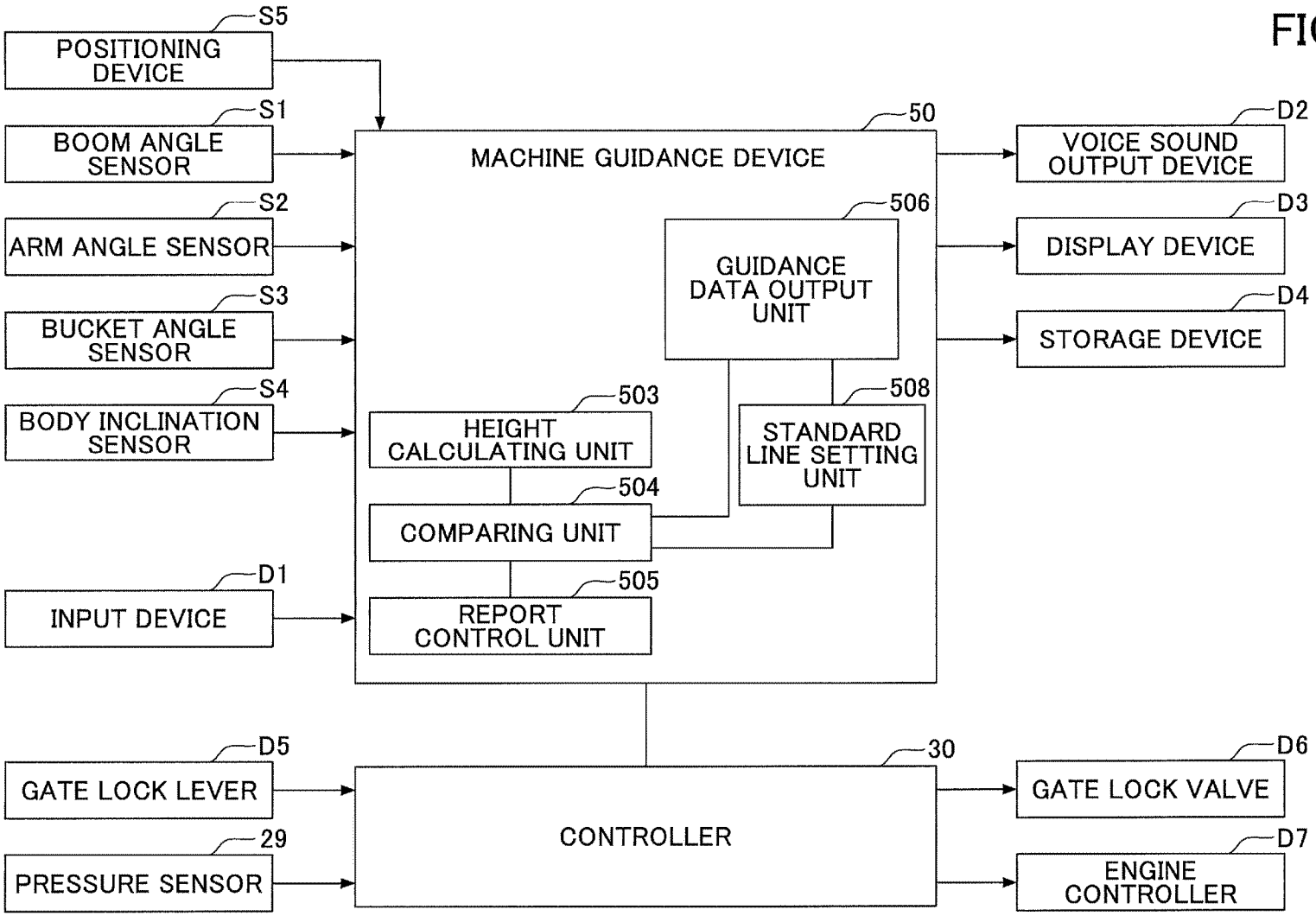
FIG. 3 is a block diagram showing the functional configurations of a controller and a machine guidance device.

Next, various functional elements provided in the controller 30 and the machine guidance device 50 will be described with reference to FIG. 3. FIG. 3 is a functional block diagram showing configurations of the controller 30 and the machine guidance device 50.

In the present embodiment, the controller 30 controls whether to perform guidance by the machine guidance device 50, in addition to controlling the operation of the entire excavator. Specifically, the controller 30 determines whether the excavator is at rest, based on the state of the gate lock lever D5 and the detection signal from the pressure sensor 29, etc. Then, when the controller 30 determines that the excavator is at rest, the controller 30 transmits a guidance stop command to the machine guidance device 50 so as to stop the guidance by the machine guidance device 50.

Furthermore, the controller 30 may output a guidance stop command to the machine guidance device 50, when outputting an automatic idle stop command to the engine controller D7. Alternatively, the controller 30 may output a guidance stop command to the machine guidance device 50 when the controller 30 determines that the gate lock lever D5 is in a pressed down state.

Next, the machine guidance device 50 will be described. In the present embodiment, the machine guidance device 50 receives various signals and data output from the boom angle sensor S1, the arm angle sensor S2, the bucket angle sensor S3, the body inclination sensor S4, the input device D1, and the controller 30. The machine guidance device 50 calculates an actual operation position of the attachment (for example, the bucket 6) based on the received signal and data. Then, when the actual operation position of the attachment is different from the target operation position, the machine guidance device 50 transmits a report command to the voice sound output device D2 and the display device D3 to issue a report. The machine guidance device 50 and the controller 30 are connected so as to communicate with each other through a CAN (Controller Area Network).

The machine guidance device 50 includes functional units that perform various functions such as a machine guidance function for guiding the operation of the excavator. In the present embodiment, the machine guidance device 50 includes a height calculating unit 503, a comparing unit 504, a report control unit 505, guidance data output unit 506, and a standard line setting unit 508, as functional units for guiding the operation of the attachment.

The height calculating unit 503 calculates the height of the tip (toe) of the bucket 6 from the angles of the boom 4, the arm 5, and the bucket 6 calculated from the detection signals of the sensors S1 to S4. Here, since the excavation is performed by the tip of the bucket 6, the tip (toe) of the bucket 6 corresponds to the work region of the end attachment. For example, when performing work of trimming earth and sand with the back surface of the bucket 6, the back surface of the bucket 6 corresponds to the work region of the end attachment. Furthermore, when a breaker is used as an end attachment other than the bucket 6, the tip of the breaker corresponds to the work region of the end attachment.

A positioning device S5 is a device for measuring the position and orientation of the excavator. In the present embodiment, the positioning device S5 is a GNSS receiver in which an electronic compass is incorporated, and the positioning device S5 measures the latitude, the longitude, and the altitude of the position where the excavator is present, and measures the orientation of the excavator. Thus, the latitude, the longitude, and the altitude of the tip (toe) of the bucket 6 can also be calculated.

The comparing unit 504 compares the height of the tip (toe) of the bucket 6 calculated by the height calculating unit 503, with the excavation target surface indicated in the guidance data output from the standard line setting unit 508.

The report control unit 505 transmits a report command to both or one of the voice sound output device D2 and the display device D3, when it is determined that reporting is necessary, based on the comparison result obtained by the comparing unit 504. Upon receipt of the report command, the voice sound output device D2 and the display device D3 issue a predetermined report to send a report to the operator of the excavator.

As described above, the guidance data output unit 506 extracts the data of the target height of the bucket 6, from the guidance data stored in advance in a storage device of the machine guidance device 50, and outputs the extracted data to the comparing unit 504. At this time, the guidance data output unit 506 outputs data indicating the target height of the bucket corresponding to the inclination angle of the excavator detected by the body inclination sensor S4.

The standard line setting unit 508 sets the excavation standard line with respect to the excavation target line, in the data output from the guidance data output unit 506, and outputs the guidance data including the excavation standard line to the comparing unit 504. The comparing unit 504 calculates each coordinate relating to the latitude, the longitude, and the altitude of the bucket 6 that have been calculated, and compares the height of the tip of the bucket 6 with the coordinates of an excavation target line TL. An excavation standard line RTL will be described later.

Figure 4:
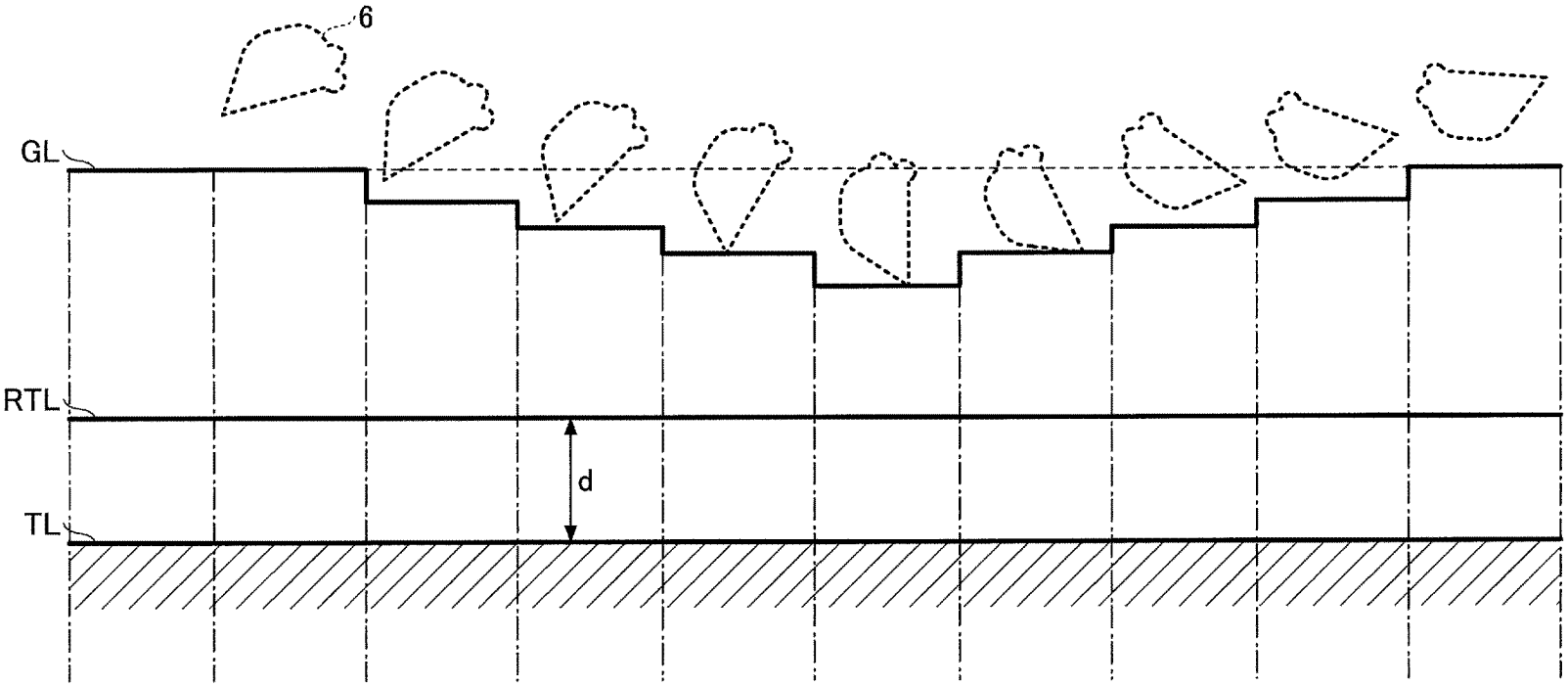
FIG. 4 is a diagram for describing an example of a guidance process according to an embodiment.

Next, an example of a guidance process by the machine guidance device 50 will be described with reference to FIG. 4. FIG. 4 is a diagram for describing an example of a guidance process when guiding the work by the bucket 6. The guidance process shown in FIG. 4 is a guidance process for setting an excavation standard surface with respect to the excavation target surface, and performing guidance based on the excavation standard surface.

The excavation standard surface in rough drilling is the surface indicated by the excavation standard line RTL on the display screen shown in FIG. 4. The excavation standard line RTL is set between a ground line GL indicating the ground surface of the place to be excavated and the excavation target line TL indicating the excavation target surface. The excavation target line TL is set as the topography data of the target landform surface corresponding to the respective coordinates relating to the latitude, the longitude, and the altitude of the construction surface. That is, the excavation standard surface indicated by the excavation standard line RTL is set to a position shallower than the excavation target surface indicated by the excavation target line TL. In this way, the coordinates of the excavation standard line RTL are also set based on the excavation target line TL.

This guidance process is carried out when the excavation target surface (excavation target line TL) is in a deep place underground, and it is necessary first to drill and scoop up a large amount of earth and sand by the bucket 6 as shown in FIG. 4. This excavation work is sometimes referred to as rough drilling. In this guidance process, the above-mentioned excavation standard line RTL is set as a reference of the excavation depth when performing rough drilling, on the display screen for guidance, and when the toe of the bucket 6 exceeds the excavation standard line RTL at the time of the rough drilling work, a report is sent to the operator by emitting a report sound.

The excavation standard line RTL is set by the standard line setting unit 508 shown in FIG. 3, in the guidance data output by the guidance data output unit 506. The excavation standard line RTL is set, for example, as a line closer to the ground surface by a predetermined distance from the excavation target line TL. That is, the excavation standard surface indicated by the excavation standard line RTL is a surface that is located higher (closer to the ground surface) than the excavation target surface indicated by the excavation target line TL, by a distance d.

Specifically, in this guidance process, when the toe of the bucket 6 exceeds the excavation standard line RTL, a report sound indicating this fact is issued (voice sound guidance) to call attention of the operator. By hearing to this report sound, the operator recognizes that the toe of the bucket 6 is put too deeply into the ground during the rough drilling work, and the operator is able to perform the rough drilling carefully so as not to scrape to the excavation target surface.

It is preferable that the report sound, which indicates that the toe of the bucket 6 has exceeded the excavation standard line RTL, is a sound different from the report sound related to the excavation target line TL, so as to be easily recognized as a report related to the excavation standard line RTL. For example, by changing the tone color, the pitch, the sound production pattern, and the sound production generation interval, etc., the report sound can be made different.

Note that it may be reported, on the display screen, that the toe of the bucket 6 has exceeded the excavation standard line RTL (screen display guidance). For example, on the display screen for guidance, the excavation standard line RTL may be displayed in addition to the excavation target line TL. Furthermore, when the toe of the bucket 6 exceeds the excavation standard line RTL, the excavation standard line RTL may change in color or may blink, to draw the attention of the operator. Furthermore, the screen display guidance and the voice sound guidance may be performed simultaneously.

In this way, by performing guidance with respect to the excavation standard line RTL in addition to the guidance with respect to the excavation target line TL, at the stage where the toe of the bucket 6 approaches the excavation target line TL up to the predetermined distance d, a report can be issued in advance before reaching the excavation target line TL. Thus, it is possible to reliably prevent the ground from being drilled to a deeper portion than the excavation target surface, during the rough drilling work.

Figure 5:
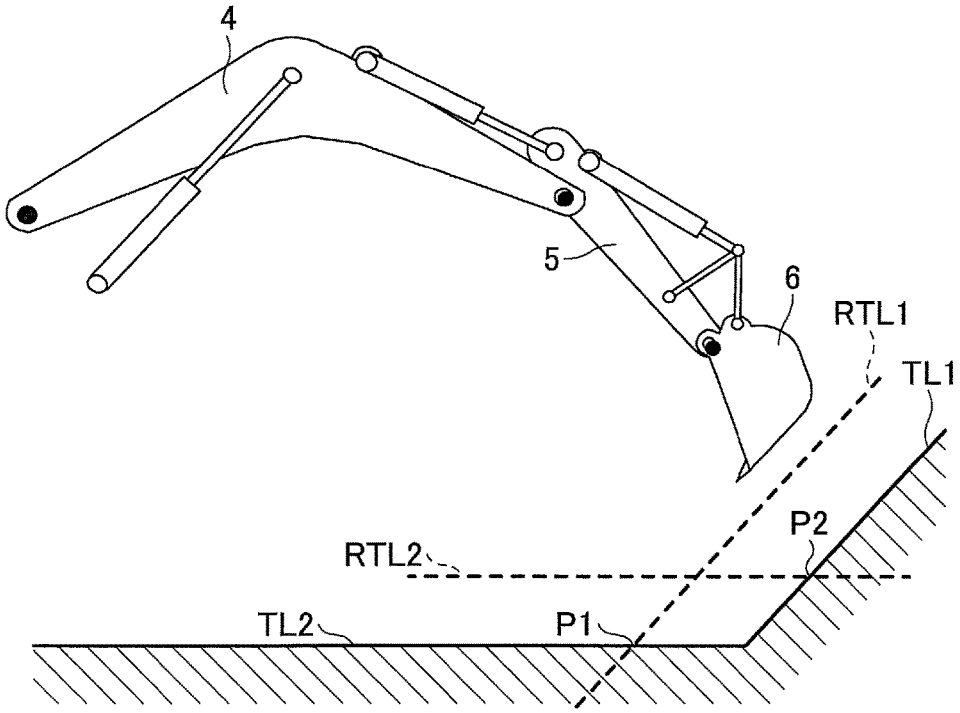
FIG. 5 is a diagram for describing an example of a guidance process performed in a case where an excavation standard line intersects an excavation target line.

FIG. 5 is a diagram for describing a process in a case where the excavation target line is bent in the guidance process described with reference to FIG. 4.

For example, as shown in FIG. 5, the excavation target line may include an excavation target line TL1 indicating an inclined surface and an excavation target line TL2 indicating a horizontal surface. In this case, there is an intersection P1 where an excavation standard line RTL1 provided for the excavation target line TL1, intersects the excavation target line TL2. Similarly, there is an intersection P2 where an excavation standard line RTL2 provided for the excavation target line TL2, intersects the excavation target line TL1.

In this case, at the intersection P1, the guidance for the excavation standard line RTL1 and the guidance for the excavation target line TL2 may compete with each other. Similarly, at the intersection P2, the guidance for the excavation standard line RTL2 and the guidance for the excavation target line TL1 may compete with each other.

Therefore, in this guidance process, guidance for the excavation target lines TL1 and TL2 is prioritized at points P1 and P2 where the excavation standard lines RTL1 and RTL 2 and the excavation target lines TL1 and TL2 intersect. That is, the fact that the toe of the bucket 6 has reached the intersection P1 means that the excavation has already been performed up to the excavation target line TL2, so this should be preferentially reported to the operator. Similarly, the fact that the toe of the bucket 6 has reached the intersection P2 means that the excavation has already been performed up to the excavation target line TL1, so this should be preferentially reported to the operator. In this case, the report sound may be different for each of the different intersecting excavation standard lines RTL1 and RTL2.

Figure 6:
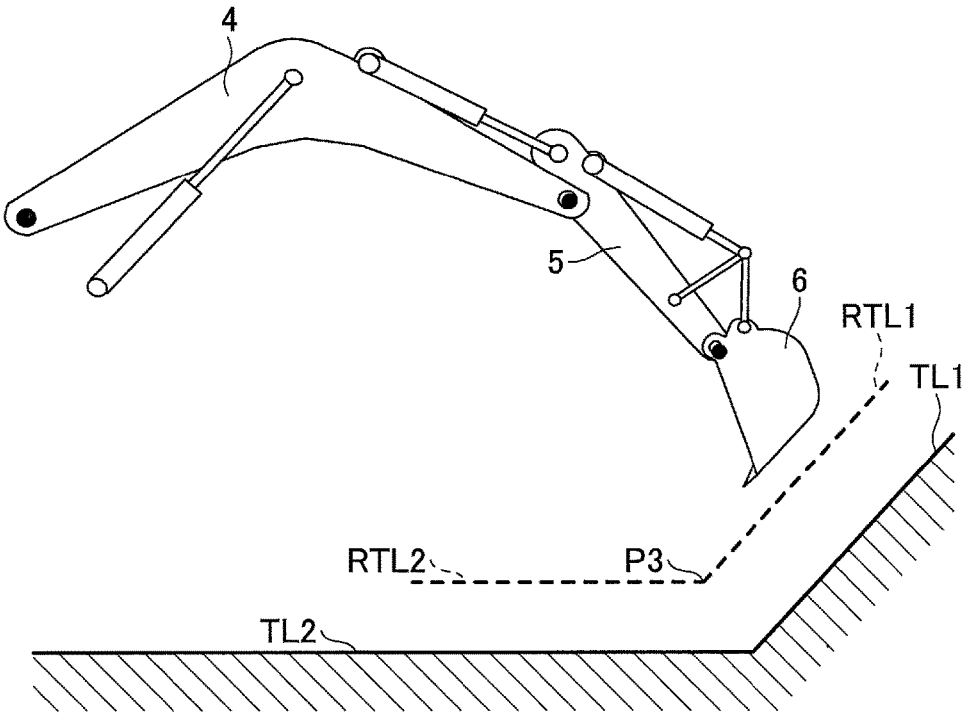
FIG. 6 is a diagram for describing an example of another guidance process performed in a case where an excavation standard line intersects an excavation target line.

Alternatively, as shown in FIG. 6, when one excavation standard line RTL1 and the other excavation standard line RTL2 intersect with each other at an intersection P3, the excavation standard line RTL1 and the excavation standard line RTL2 may be set not to extend beyond the intersection P3. By setting the excavation standard line RTL1 and the excavation standard line RTL2 in this way, competition of guidance does not occur. In this case also, the report sound may be different for each of the different intersecting excavation standard lines RTL1 and RTL2.

Next, a guidance process according to another embodiment will be described with reference to FIG. 7. In the guidance process described above, the excavation standard line is set as a standard line to be set at the time of rough drilling work. However, in this guidance process, for example, a standard line indicating the work amount per day is set as work amount standard lines WTL1 and WTL2. The work amount standard lines WTL1 and WTL2 are set by the standard line setting unit 508 shown in FIG. 3, when deep excavation work, for which the excavation cannot be performed up to the excavation target surface within a work unit of a predetermined time (for example, one day of work), and a plurality of excavation work units (excavation work over several days, for example) are performed to complete the deep excavation work. Note that in FIG. 7, it is assumed that the excavation target line TL indicates a bent target surface (a surface in which a horizontal surface and an inclined surface are connected), and the work amount standard lines WTL1 and WTL2 also indicate bent standard surfaces.

Figure 7:
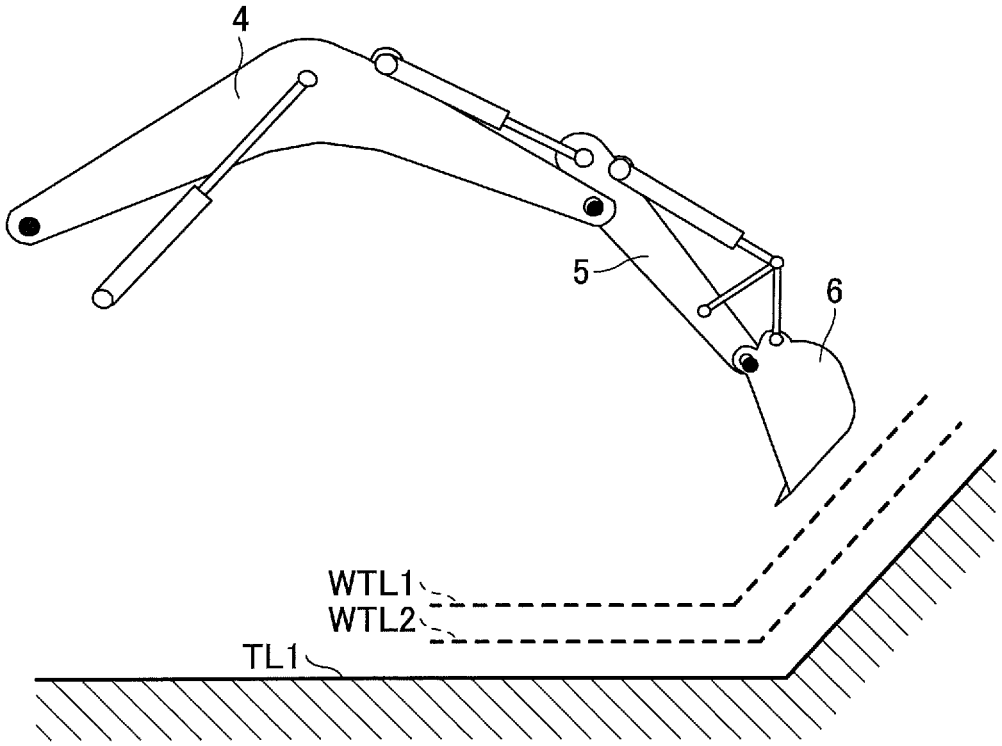
FIG. 7 is a diagram for describing a guidance process according to another embodiment.

In FIG. 7, the work amount standard line WTL1 is a standard line indicating how far to excavate in the excavation work on the first day, for example. As the work on the first day, the operator performs excavation to the surface indicated by the work amount standard line WTL1. Since the work amount standard line WTL1 is displayed on the screen, the operator can easily recognize the excavation depth corresponding to the work amount of one day, and can perform excavation work efficiently and systematically.

Note that the work amount standard line WTL2 is a standard line indicating how far to excavate on the second day. The work amount standard line WTL2 is set when the excavation work extends over three days or more. It is possible to display the work amount standard lines WTL1 and WTL2 at the same time; however, in the excavation work of the first day, the work amount standard line WTL1 may be displayed, and in the excavation work on the second day, the work amount standard line WTL2 may be displayed.

Furthermore, when the excavation work can be completed in two days, only the work amount standard line WTL1 is set and displayed without setting the work amount standard line WTL2.

Furthermore, the report sound may be different for different work amount standard lines of different heights from the target surface.

Note that also in this guidance process, the position of the toe of the bucket 6 may be reported by voice sound guidance, similar to the case of the excavation standard line during the rough drilling work described above.

Next, a screen configuration displayed on the display device D3 will be described.

Figure 8:
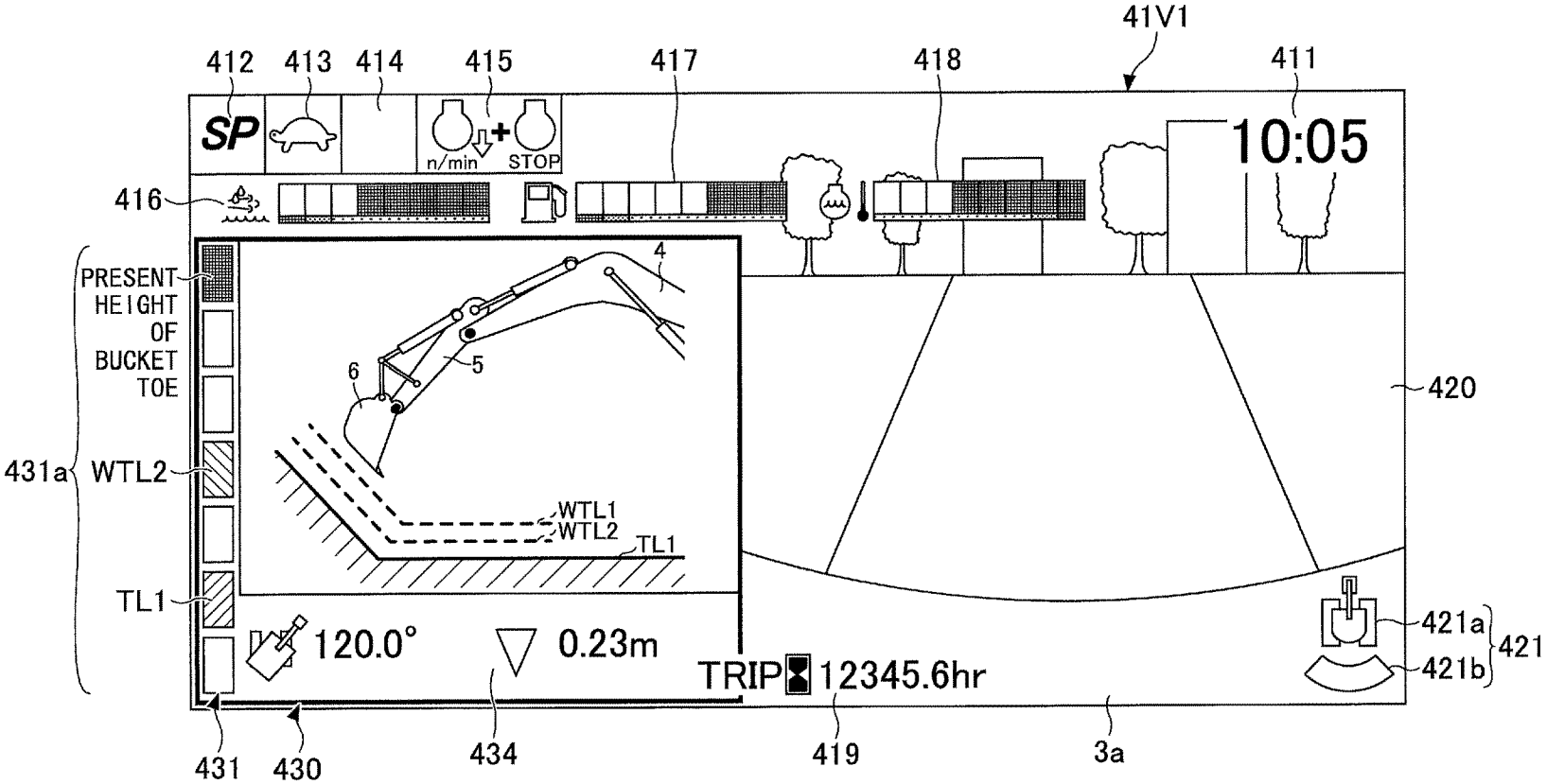
FIG. 8 is a diagram exemplifying an operation screen of a display device according to an embodiment.

FIG. 8 is a diagram exemplifying a non-operation screen 41V1 displayed on an image display unit 41 of the display device D3 according to the embodiment.

As shown in FIG. 8, the non-operation screen 41V1 includes a time display section 411, a rotational speed mode display section 412, a traveling mode display section 413, an attachment display section 414, an engine control state display section 415, a urea water remaining amount display section 416, a fuel remaining amount display section 417, a cooling water temperature display section 418, an engine operation time display section 419, a captured image display section 420, and a work guidance display section 430. The image displayed in each section is generated by a conversion processing unit 40*a* of the display device D3, from various kinds of data transmitted from the controller 30 and captured images transmitted from an imaging apparatus 80.

The time display section 411 displays the present time. In the example shown in FIG. 8, a digital display is adopted, and the present time (10:05) is shown.

The rotational speed mode display section 412 displays an image of the rotational speed mode set by an engine rotational speed adjustment dial 75. The rotational speed mode includes, for example, the four modes of the above-described SP mode, the H mode, the A mode, and the idling mode. In the example shown in FIG. 8, the symbol "SP" representing the SP mode is displayed.

The traveling mode display section 413 displays the traveling mode. The traveling mode represents the setting state of the traveling hydraulic motor using a variable displacement pump. For example, the traveling mode includes a low speed mode and a high speed mode. In the low speed mode, a mark representing a "turtle" is displayed, and in the high speed mode, a mark representing a "rabbit" is displayed. In the example shown in FIG. 8, a mark representing "turtle" is displayed, and the operator can recognize that the low speed mode is set.

The attachment display section 414 displays an image representing the attachment that is mounted. Various end attachments such as the bucket 6, a rock drill, a grapple, and a lifting magnet, etc., are mounted on the excavator. For example, the attachment display section 414 displays marks representing these end attachments and numbers corresponding to the attachments. In the present embodiment, the bucket 6 is mounted as an end attachment, and as shown in FIG. 8, the attachment display section 414 is blank. In the case where a rock drilling machine is mounted as an end attachment, for example, a mark representing a rock drilling machine is displayed in the attachment display section 414 together with a number indicating the output size of the rock drill.

The engine control state display section 415 displays the control state of the engine 11. In the example shown in FIG. 8, "automatic deceleration/automatic stop mode" is selected as the control state of the engine 11. Note that the "automatic deceleration/automatic stop mode" means a control state in which the engine rotational speed is automatically reduced in accordance with the duration of a state in which the engine load is small, and then the engine 11 is automatically stopped. Furthermore, the control state of the engine 11 includes an "automatic deceleration mode", an "automatic stop mode", and a "manual deceleration mode", etc.

The urea water remaining amount display section 416 displays an image of the remaining amount state of urea water stored in a urea water tank. In the example shown in FIG. 8, a bar graph representing the present remaining amount state of urea water is displayed. Note that the remaining amount of the urea water is displayed based on data output by a urea water remaining amount sensor provided in the urea water tank.

The fuel remaining amount display section 417 displays the state of the remaining amount of fuel stored in a fuel tank. In the example shown in FIG. 8, a bar graph representing the present fuel remaining amount state is displayed. Note that the remaining amount of fuel is displayed based on data output from a fuel remaining amount sensor provided in the fuel tank.

The cooling water temperature display section 418 displays the temperature state of the engine cooling water. In the example shown in FIG. 8, a bar graph representing the temperature state of the engine cooling water is displayed. Note that the temperature of the engine cooling water is displayed based on data output from a water temperature sensor 11*c* provided in the engine 11.

The engine operation time display section 419 displays the cumulative operation time of the engine 11. In the example shown in FIG. 8, the cumulative operation time since the count has been restarted by the driver, is displayed together with the unit "hr (hour)". The engine operation time display section 419 displays a lifetime operating time of the entire period since the excavator has been manufactured, or an interval operating time since the operator has restarted the count.

The captured image display section 420 displays an image captured by the imaging apparatus 80. In the example shown in FIG. 8, an image captured by a rear camera 80B is displayed in the captured image display section 420. A captured image captured by a left camera 80L or a right camera 80R may be displayed in the captured image display section 420. Furthermore, in the captured image display section 420, images captured by a plurality of cameras among the left camera 80L, the right camera 80R, and the rear camera 80B may be displayed so as to be aligned. Furthermore, in the captured image display section 420, an overhead image, etc., obtained by combining captured images captured by the left camera 80L, the right camera 80R, and the rear camera 80B, respectively, may be displayed.

Not that each camera is installed so that a part of a cover 3*a* of the upper turning body 3 is included in the image to be captured. By including a part of the cover 3*a* in the displayed image, the operator can easily grasp the sense of distance between the object displayed in the captured image display section 420 and the excavator.

In the captured image display section 420, an imaging apparatus icon 421 representing the orientation of the imaging apparatus 80 that has captured the captured image being displayed, is displayed. The imaging apparatus icon 421 is constituted by an excavator icon 421*a* representing the shape of the excavator when viewed from the top and a belt-like direction display icon 421*b* representing the direction of the imaging apparatus 80, which has captured the captured image being displayed.

In the example shown in FIG. 8, the direction display icon 421*b* is displayed below the excavator icon 421*a* (the opposite side to the attachment). This represents that the captured image display section 420 is displaying an image behind the excavator, captured by the rear camera 80B. For example, when an image captured by the right camera 80R is displayed in the captured image display section 420, the direction display icon 421*b* is displayed on the right side of the excavator icon 421*a*. Furthermore, for example, when an image captured by the left camera 80L is displayed in the captured image display section 420, the direction display icon 421*b* is displayed on the left side of the excavator icon 421*a*.

For example, by pressing an image changeover switch provided in the cabin 10, the operator can switch the image displayed in the captured image display section 420 to an image, etc., captured by another camera, etc.

Note that when the excavator is not provided with the imaging apparatus 80, different information may be displayed instead of the captured image display section 420.

The work guidance display section 430 includes a position display image 431 and a numerical value information image 434, and displays various kinds of work information.

The position display image 431 is a bar graph in which a plurality of bars 431*a* are vertically arranged, and displays the distance from the work region of the attachment (for example, the tip of the bucket 6) to the target surface. In the present embodiment, one of the seven bars is a bucket position display bar, which is displayed in a different color from the other bars, according to the distance from the tip of the bucket 6 to the target surface (the first boar from the top in FIG. 8). Note that the position display image 431 may be constituted by multiple bars so that the distance from the tip of the bucket 6 to the target surface can be displayed with higher accuracy. Furthermore, in FIG. 8, only the work amount standard line WTL2 close to the excavation target line TL is displayed in the plurality of bars 431*a*; however, both the work amount standard line WTL2 and the work amount standard line WTL1 may be displayed.

For example, as the distance from the tip of the bucket 6 to the target surface becomes larger, an upper bar is displayed in a color different from that of the other bars, as a bucket position display bar. Furthermore, as the distance from the tip of the bucket 6 to the target surface becomes smaller, a lower bar is displayed in a color different from that of the other bars, as a bucket position display bar. In this way, the bucket position display bar is displayed so as to move up and down according to the distance from the tip of the bucket 6 to the target surface. By viewing the position display image 431, the operator can grasp the distance from the tip of the bucket 6 to the target surface.

The numerical value information image 434 displays various numerical values indicating the positional relationship between the tip of the bucket 6 and the target surface. In the numerical value information image 434, the turning angle (120.0° in the example shown in FIG. 8) with respect to the reference of the upper turning body 3 is displayed together with an icon indicating the excavator. Also, in the numerical value information image 434, the height from the target surface to the tip of the bucket 6 (the distance in the vertical direction between the tip of the bucket 6 and the target surface; 0.23 m in the example shown in FIG. 8) is displayed together with an icon indicating the positional relationship with the target surface.

Figure 9:
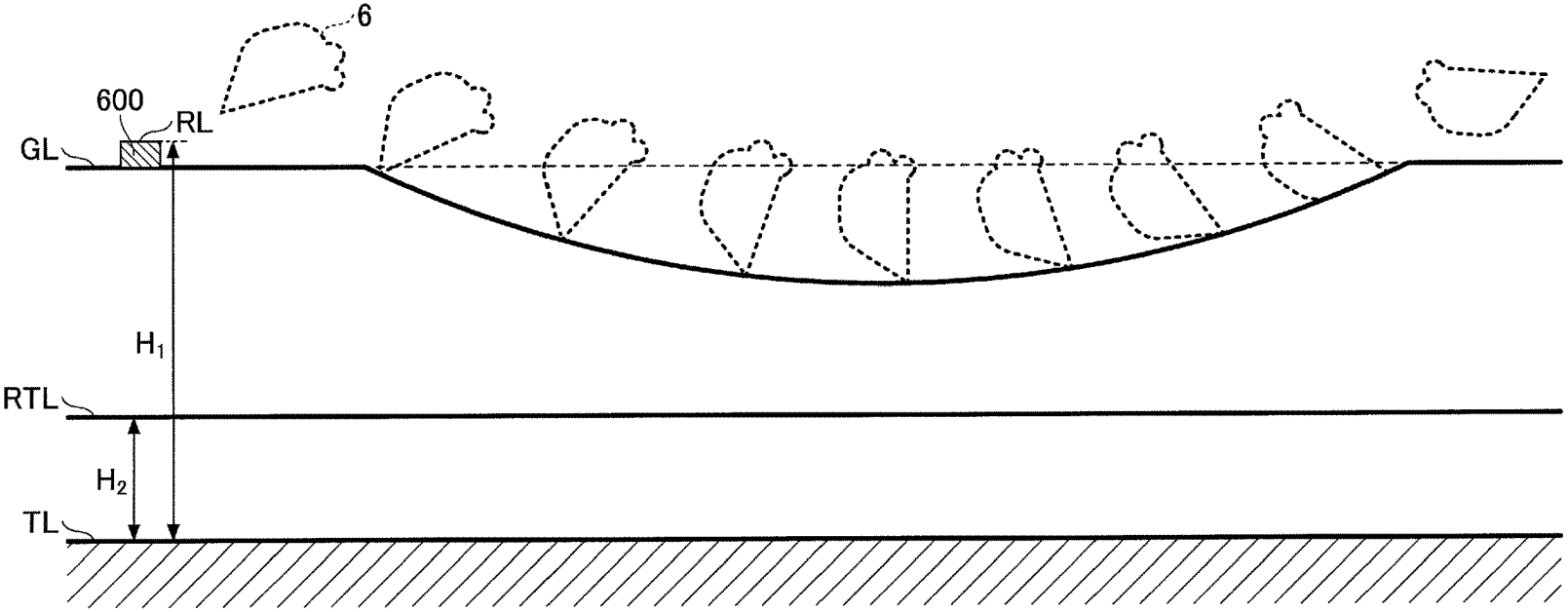
FIG. 9 is a diagram for describing a guidance process in a case of not using a positioning device, which is a GNSS receiver.

Next, a guidance process in the case of not using the positioning device S5, which is a GNSS receiver, will be described with reference to FIG. 9.

First, at the site where the excavation work is carried out, a reference peg 600, which is used for the measurement for determining the reference height, is knocked in and fixed. The reference peg 600 is embedded such that the upper end surface of the reference peg 600 is slightly protruded from the ground surface. The upper end surface of the reference peg 600 becomes a reference surface RL.

The excavation target line surface indicated by the excavation target line TL is set by the depth from the reference surface. In the example shown in FIG. 9, the excavation target surface (excavation target line TL) is set at the position of a depth $H_1$ from the reference surface RL. Furthermore, the excavation standard line RTL indicating the excavation standard surface is set by the height from the excavation target line TL. In the example shown in FIG. 9, the excavation standard line RTL is set at a position above the excavation target line TL by a height $H_2$.

Before performing the excavation work, the operator of the excavator first moves the bucket 6 onto the reference peg 600, and brings the tip (toe) of the bucket 6 into contact with the upper end face of the reference peg 600. Based on the attitude of the attachment at this time, the relative height between the position of a boom pin which is the joint portion of the upper turning body 3 and the boom 4, and the reference surface RL, is obtained. The height of the reference surface RL can be determined by the positioning data from the positioning device S5 (GNSS receiver).

Here, it is assumed that the excavation work will be performed only by operating the attachment, without moving the excavator. In this case, by obtaining the height of the boom pin as a fixed position on the upper turning body 3, the height of the tip of the bucket 6 with respect to the upper turning body 3 can be obtained, even if the attitude of the attachment is changed. As a result, the relative height (depth) of the tip of the bucket 6 with respect to the reference surface RL can be obtained. Therefore, it is possible to calculate the relative height of the tip of the bucket 6 with respect to each of the excavation standard line RTL and the excavation target line TL.

In the embodiment described above, the guidance for the tip of the bucket 6 has been described; however, the present embodiment is not necessarily limited to the tip of the bucket 6. Any position of the bucket 6 may be used as a reference of the guidance. For example, when constructing a slope face, since the work is carried out by using the back face of the bucket 6, in this case, it is preferable to use any position on the back face of the bucket 6 as a reference of guidance.

According to the disclosed embodiment, guidance is performed based on a standard line set with respect to the depth to be excavated, on a display screen. Accordingly, it is possible to report to the operator that excavation has been performed up to the depth to be excavated by the excavation work.

Preferred embodiments and examples of the present invention including the excavator are described above; however, the present invention is not limited to the above-described embodiments and examples. Furthermore, variations and modifications may be made to the present invention in view of the scope of the claims attached hereto.

What is claimed is:

1. An excavator comprising a machine guidance device having a machine guidance function, wherein the machine guidance function sets a standard surface at a position closer to a ground surface than an excavation target surface, compares a height of a region of work by an end attachment with a height of the excavation target surface to perform guidance by a report sound based on a result of the comparison, and compares the height of the region of work by the end attachment with a height of the standard surface, to perform guidance by a report sound based on a result of the comparison.

2. The excavator according to claim 1, wherein the report sound relating to the excavation target surface is a different sound from the report sound relating to the standard surface.

3. The excavator according to claim 1, wherein the excavator prioritizes the guidance relating to the excavation target surface over the guidance relating to the standard surface.

4. The excavator according to claim 1, wherein the standard surface is set for each predetermined work time.

5. The excavator according to claim 1, wherein a standard line indicating the standard surface is displayed on a display screen for the guidance.

6. The excavator according to claim 1, wherein when a standard line indicating the standard surface intersects an excavation target line indicating the excavation target surface, the excavator prioritizes the guidance relating to the excavation target surface at a point where the standard line and the excavation target line intersect each other.

7. The excavator according to claim 1, wherein when a standard line indicating the standard surface intersects another standard line indicating another standard surface, the excavator sets the standard line and the other standard line so as not to extend beyond an intersection point where the standard line and the other standard line intersect each other.

8. The excavator according to claim 7, wherein the report sound differs for each of the standard line and the other standard line.

9. The excavator according to claim 1, wherein the excavator sets a plurality of work amount standard lines at different heights from the standard surface, and performs the guidance for excavation up to a surface indicated by each of the plurality of work amount standard lines.

10. The excavator according to claim 9, wherein the report sound differs for each of the plurality of work amount standard lines.

11. The excavator according to claim 1, further comprising a pressure reducing valve configured to delay a movement of the end attachment, when the end attachment exceeds the standard surface.

12. The excavator according to claim 5, wherein the guidance performed with respect to the standard line is executed at a time of rough drilling work.

13. The excavator according to claim 5, wherein the standard line is set for each unit of work.

14. The excavator according to claim 5, wherein the excavator displays a guidance display section configured to display both the standard line and the excavation target surface, adjacent to a captured image display section configured to display an image captured by a rear camera.

15. The excavator according to claim 5, wherein the excavator displays a guidance display section configured to display both the standard line and the excavation target surface, and further displays a numerical value indicating a positional relationship between a bucket tip and the excavation target surface.

16. The excavator according to claim 5, wherein the standard line and the excavation target surface are determined based on a reference surface and an attitude of the attachment when contacting the reference surface.

* * * * *